US008753037B2

(12) United States Patent
Hewing et al.

(10) Patent No.: US 8,753,037 B2
(45) Date of Patent: Jun. 17, 2014

(54) DEVICE FOR A DEVICE FOR THE TREATMENT, COOLING OR STORAGE OF A FLUID SUCH AS A GAS OR A LIQUID

(75) Inventors: Bernd Hewing, Ochtrup (DE); Frank Dirkskoetter, Ochtrup (DE)

(73) Assignee: Hewitech GmbH & Co. KG, Ochtrup (DE)

( * ) Notice: Subject to any disclaimer, the term of this patent is extended or adjusted under 35 U.S.C. 154(b) by 682 days.

(21) Appl. No.: 12/943,206

(22) Filed: Nov. 10, 2010

(65) Prior Publication Data

US 2011/0108559 A1 May 12, 2011

(30) Foreign Application Priority Data

Nov. 12, 2009 (DE) ..... 10 2009 052 724

(51) Int. Cl.
*E02B 11/00* (2006.01)
*B65G 5/00* (2006.01)
*E21F 17/16* (2006.01)

(52) U.S. Cl.
USPC ..... 405/52; 405/53; 405/45; 405/129.1; 405/36; 405/43; 405/50; 405/129.85

(58) Field of Classification Search
None
See application file for complete search history.

(56) References Cited

U.S. PATENT DOCUMENTS 6,095,718 A 8/2000 Bohnhoff
6,428,870 B1 * 8/2002 Bohnhoff ..... 428/44
7,712,997 B2 5/2010 Roelfsema
8,162,567 B2 * 4/2012 Obermeyer ..... 405/50
2005/0155285 A1 7/2005 Urban et al.

FOREIGN PATENT DOCUMENTS

DE 202006008981 U1 9/2006
EP 1452653 A1 9/2004
EP 1 607 534 A1 12/2005
JP 09-296486 A 11/1997

OTHER PUBLICATIONS

Search Report for European Patent Application No. 10190822, dated Feb. 14, 2011.

* cited by examiner

*Primary Examiner* — Benjamin Kurtz
(74) *Attorney, Agent, or Firm* — Dardi & Herbert, PLLC; Peter S. Dardi

(57) ABSTRACT

The device is provided with a plurality of intermediate grid plate elements (12) with a top and a bottom surface, which are adapted to be positioned one on top of the other. Each intermediate grid plate element (12) comprises a grate strutting (18, 19) as well as a plurality of support members (20) which are distributed, in particular in a regular manner, over the intermediate grid plate element (12), wherein said support members (20) extend between the bottom face and the top face of an element in a direction substantially transverse to the extension of the intermediate grid plate elements (12) and are supported on the support members (20) of an adjacent intermediate grid plate element (12) arranged below a respective intermediate grid plate element (12), and support the support members (20) of an adjacent intermediate grid plate element (12) arranged above said respective intermediate grid plate element (12).

4 Claims, 6 Drawing Sheets

DEVICE FOR A DEVICE FOR THE TREATMENT, COOLING OR STORAGE OF A FLUID SUCH AS A GAS OR A LIQUID

CROSS REFERENCE TO RELATED APPLICATIONS

The present invention claims the priority of German Patent Application no. DE 10 2009 052 724.9 filed on Nov. 12, 2009, the disclosures of which are incorporated herein by reference.

BACKGROUND OF THE INVENTION

1. Field of the Invention

The invention refers to a device for a device for the treatment, cooling or storage of a fluid such as a gas or a liquid.

2. Description of the Prior Art

Devices for the above mentioned purposes are known in various designs. Such devices are used for instance as drainage or dewatering devices which serve for the subterraneous storage of surface water, for example. Such drainage or dewatering bodies with grated structures for filling cavities in the ground are generally known. The mostly cubic or parallelepiped grated boxes are usually enclosed on all sides by a non-woven so as to prevent the intrusion of soil into the grated box. Sometimes flushing channels run through the known grated boxes. It is possible to connect a plurality of such grated boxes so as to increase the cavity in the ground that is used to drain and dewater and to intermediately store and eventually discharge surface water.

Depending on the space available, drainage or dewatering boxes of different sizes are used. As a consequence, these boxes have to be produced and stored in different sizes. This results in increased logistic efforts on the part of the manufacturer and the distributor.

It is already known to manufacture grated boxes of different sizes by combining similar grated box parts. EP-A-1 607 354 describes an example of this. From DE-U-20 2006 008 981, a seepage and drainage body formed from individual disc- or plate-shaped system elements, which elements are arranged side by side or one after the other when the seepage or drainage body is in its installed condition. Each plate element thus has to absorb the entire load of the soil above the body.

SUMMARY OF THE INVENTION

It is an object of the invention to provide a modular device for a device for the treatment, cooling or storage of a fluid such as, for instance, a gas or a liquid.

To achieve this object, the invention proposes a device for a device for the treatment, cooling or storage of a fluid such as, for instance, a gas or a liquid, which is provided with

- a plurality of intermediate grated or grid plate elements with a top and a bottom surface, which are adapted to be stacked one on top of the other,
- wherein each intermediate grated plate element comprises a grate strutting as well as a plurality of support members which are distributed, in particular in a regular manner, over the intermediate grated plate element, wherein said support members extend between the bottom face and the top face of an element in a direction substantially transverse to the extension of the intermediate grated plate elements and are supported on the support members of an adjacent intermediate grated plate element arranged below a respective intermediate grated plate element, and support the support members of an adjacent intermediate grated plate element arranged above said respective intermediate grated plate element.

The concept of the device of the invention (described hereinafter with reference to the use thereof in a dewatering or drainage device) is based on the use of similar parts, namely the intermediate grated plate elements, which, according to the invention, are arranged one on top of the other, whereby the height of the (dewatering or drainage) device body can be adapted to the existing available space when installed. The weight forces acting on the stack of intermediate grated plate elements are absorbed by the support members of the intermediate grated plate elements, by which respective adjacent intermediate grated plate elements rest on each other. This results in a modular system that meets the load bearing requirements that exist in practice.

According to an embodiment of the invention, it is provided that the support members are of a strand-shaped design and are, in particular, formed as bolts, their opposite ends being provided with a connecting projection at the one end and a connecting projection receptacle at the other end, wherein adjacent support members or adjacent groups of support members have their top face or bottom face ends alternately provided with connecting projections or connecting projection receptacles, and wherein adjacent intermediate grated plate elements are plugged together by means of the connecting projections and the connecting projection receptacles with the support members being connected in a load transmitting manner.

In another advantageous embodiment of the invention, it is provided that a grated plate top element is placed on the topmost intermediate grated plate element in the stack and/or a grated plate bottom element is placed under the lowermost grated plate element in the stack, which top and bottom elements are identical and each comprise a grate strutting and support members protruding to one side for connection with the support members of the topmost or the lowermost intermediate grated plate element of the stack. In particular, the grated plate top element or the grated plate bottom element are the upper or the lower half of a intermediate grated plate element theoretically divided along its extension. The same may be provided with further strutting.

Thus, the construction of a device for instance as a dewatering or drainage body according to the invention, first requires a plurality of intermediate grated plate elements, wherein the stack of these elements may end in a grated plate top element or a grated plate bottom element. However, both latter elements are not of ultimate necessity.

The modular system of the invention may advantageously be completed with a grated flushing, inspection or connection channel element integrated into the stack of intermediate grated plate elements. This grated channel element has a top face on which a intermediate grated plate element rests, as well as a bottom face which rests on a intermediate grated plate element. The manner in which the grated channel element is connected with the respective adjacent intermediate grated plate elements is advantageously the same as the connection between adjacent intermediate grated plate elements. In other words: support members also extend through the grated channel element in the thickness direction thereof, which support members advantageously are strand-shaped and are formed in particular as rod sections or bolts.

Further, it is possible and advantageous to arrange a grated channel element between two adjacent intermediate grated plate elements, the grated channel element comprising a top face and a bottom face, a grate strutting comprising a flushing channel extending transversely to the thickness between the top and bottom faces, and further comprising support members extending from the top face to the bottom face for connection with the support members of the respective intermediate grated plate element arranged above or below the grated channel element.

In an advantageous development of the invention, the grated channel element comprises four identical grated channel sub-elements, of which a first pair is arranged side by side and a second pair is arranged on the first pair, wherein each grated channel sub-element comprises a grate strutting with support members substantially extending transversely to the extension thereof, and further comprises a channel inner side portion at one edge, which portion substantially extends over one quarter of the channel cross section and is provided with perforations, wherein two respective juxtaposed grated channel sub-elements extend symmetrically with respect to a plane extending in the direction of stacking and two respective grated channel sub-elements arranged one on top of the other are arranged symmetrically with respect to a plane extending transversely to the direction of stacking.

As an alternative, it is provided that the grated channel element comprises two identical grated channel sub-elements arranged side by side and symmetrically to a plane extending in the direction of stacking, wherein each grated channel sub-element comprises a grate strutting with support members extending substantially transversely to the extension thereof and an edge, forming an inner side portion of the channel extending over substantially half the cross section of the channel and being provided with perforations. In this embodiment the channel plane is formed by two identical grated channel sub-elements.

Overall, the invention provides a modular system for the assembly of device bodies which can be assembled from a maximum of three different elements, the number of intermediate grated plate elements stacked one on the other being chosen as a function of the dimensions of the space to be filled by the device body.

It may be considered another particularity of the device according to the invention that the intermediate grated plate elements and, if present, the grated channel elements, as well as their sub-elements, have geometrically identical grate structures. Due to the alignment of the grate openings of all elements, passages extending in the direction of stacking are formed in the device body. This is particularly advantageous for the treatment, storage and other types of processing of more heavily polluted fluids (for instance, in waste water plants, in which the device can be used as a trickling filter or a bioreactor (for instance, as an immersed packed bed)).

Hereinabove, the invention has been described with reference to the device being used in a dewatering and/or drainage device. However, the range of application of the present device exceeds this application by far. Generally, the present device can be used in a device for the humidification, storage, purification or similar treatment and/or the cooling of a fluid (gas or liquid) such as air, for instance. Such devices are known as evaporation humidifiers or mass exchangers which, among other purposes, are used for humidifying and simultaneously cooling the air in domestic or office buildings, storage buildings, stables, greenhouses, and other rooms, and are also used in technical installations, for instance, to purify and, in particular, to remove dust from feed or exhaust air, and for reactive gas and air purification (in particular the removal of odorous substances such as ammonia from stable exhaust air). Cooling a gas using such devices is effected according to the principle of evaporation cooling. Examples of other devices in which the present device can be used are waste water plants, cooling towers and gas washers.

BRIEF DESCRIPTION OF THE DRAWINGS

A full and enabling disclosure of the present invention including the best mode thereof, enabling one of ordinary skill in the art to carry out the invention, is set forth in greater detail in the following description, including reference to the accompanying drawing in which.

DESCRIPTION OF PREFERRED EMBODIMENTS

Figure 1:
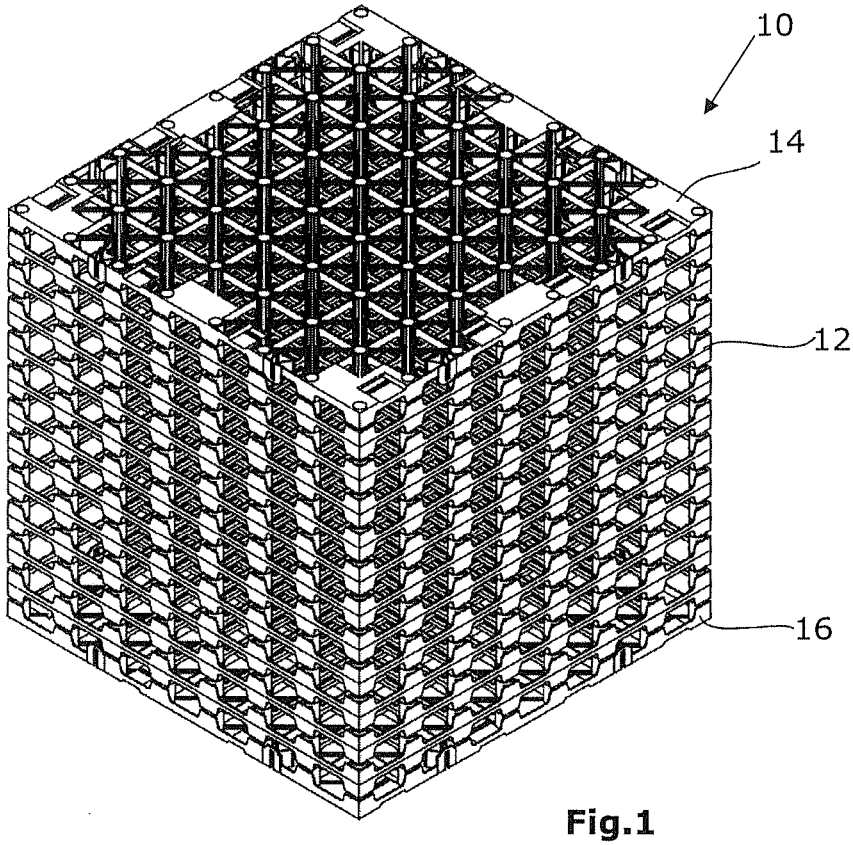
FIG. 1 is a perspective view of a dewatering and/or drainage body formed by a stack of intermediate grid plate elements with a grid plate top element and a grid plate bottom element.
Figure 2:
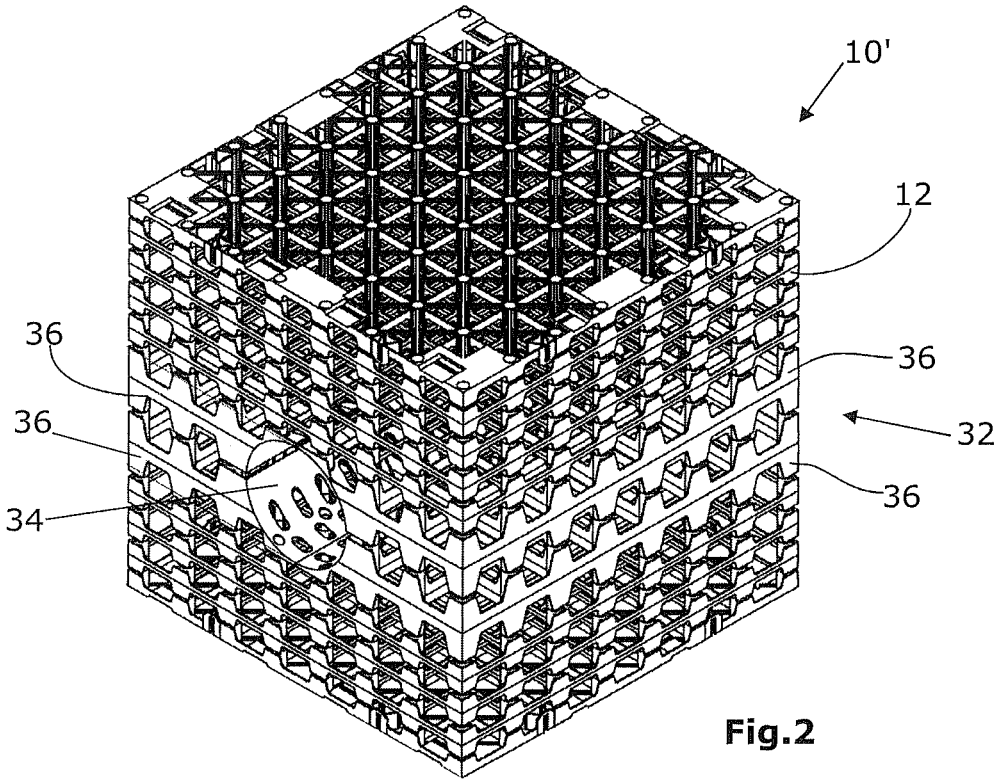
FIG. 2 is a perspective view of another dewatering and/or drainage body formed by a stack of intermediate grid plate elements with a grid flushing channel element arranged in this stack and a grid plate top element, as well as a grid plate bottom element, FIG. 3 a top plan view on a intermediate grid plate element.
Figure 3:
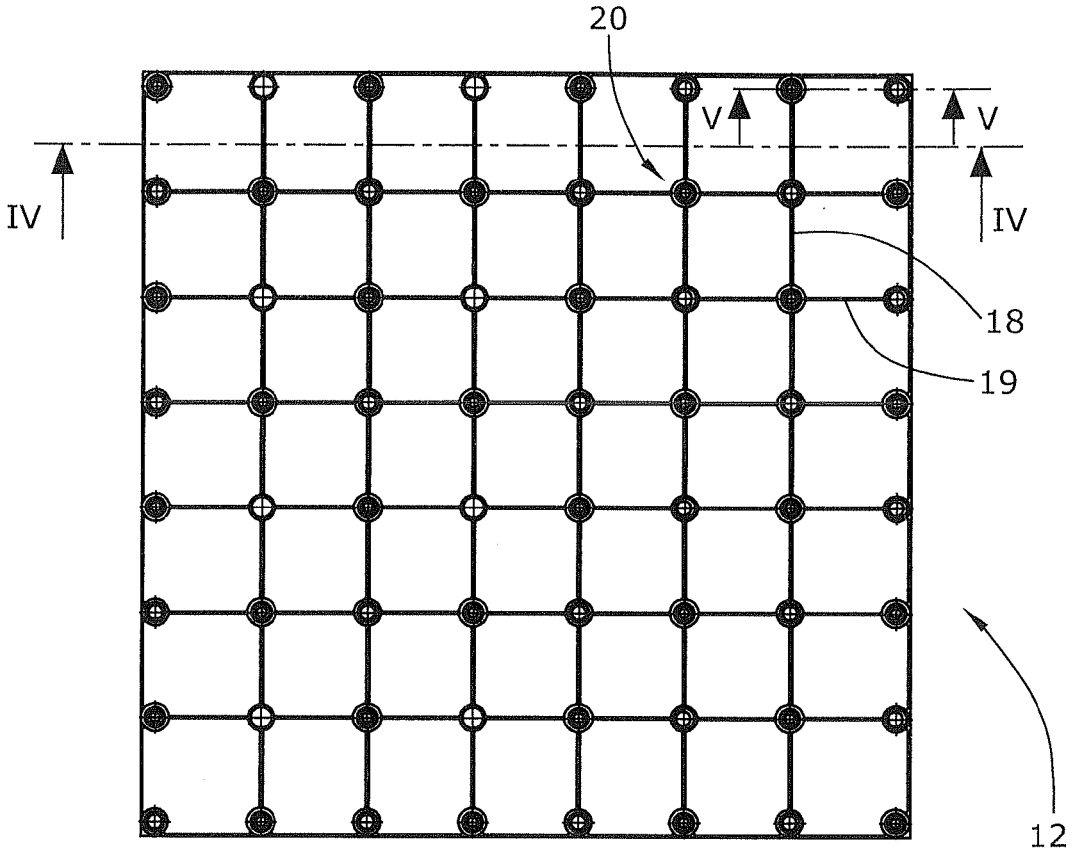
Figure 4:
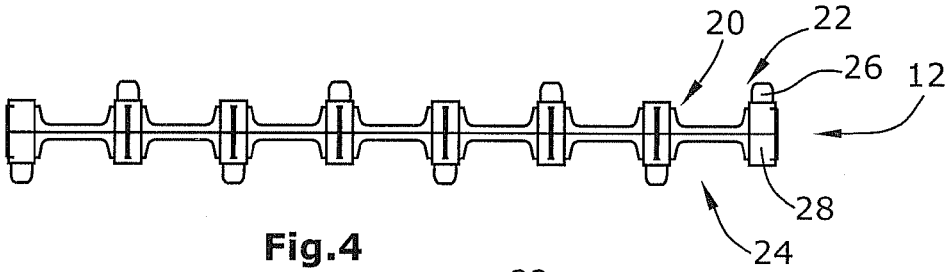
FIG. 4 is a section through the intermediate grid plate element along line IV-IV in FIG. 3.
Figure 5:
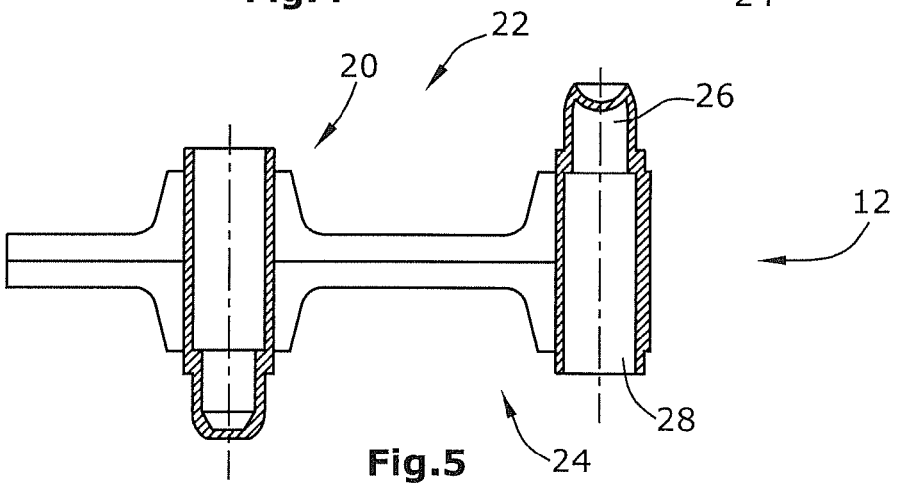
FIG. 5 is a section along line V-V through a part of the intermediate grid plate element in FIG. 3.
Figure 6:
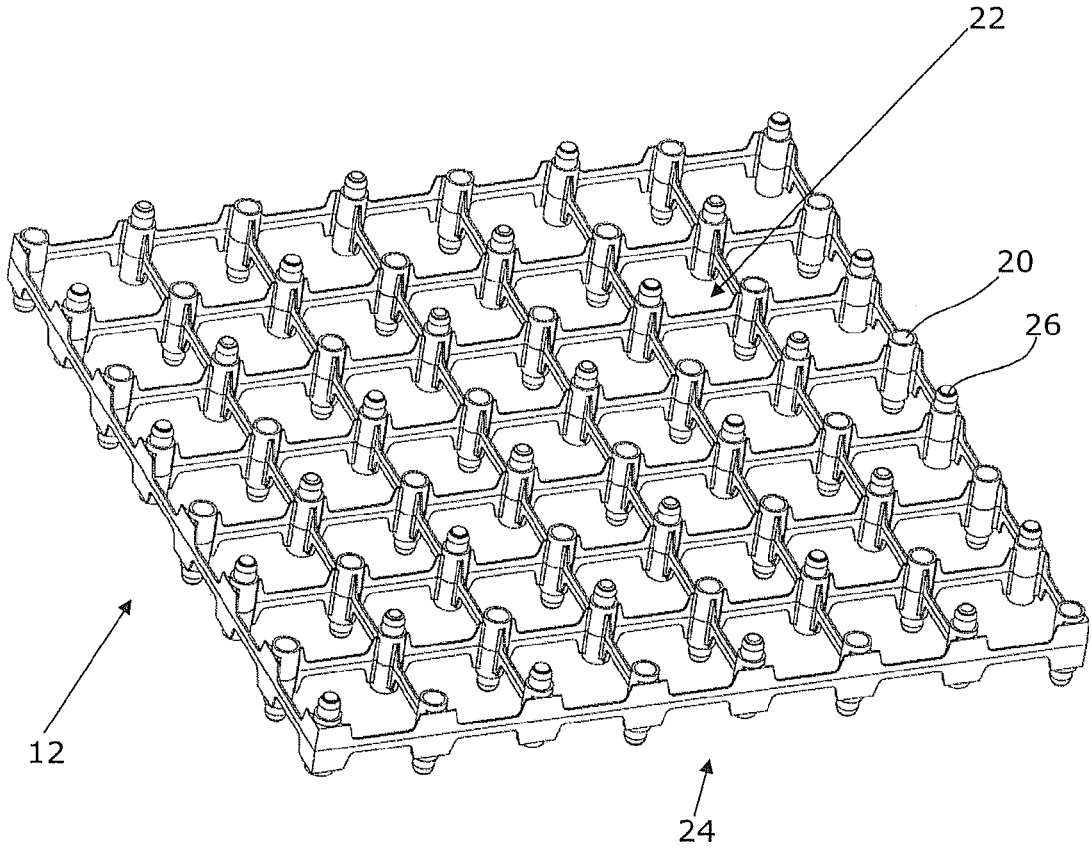
FIG. 6 is a perspective view of the intermediate grid plate element.
Figure 7:
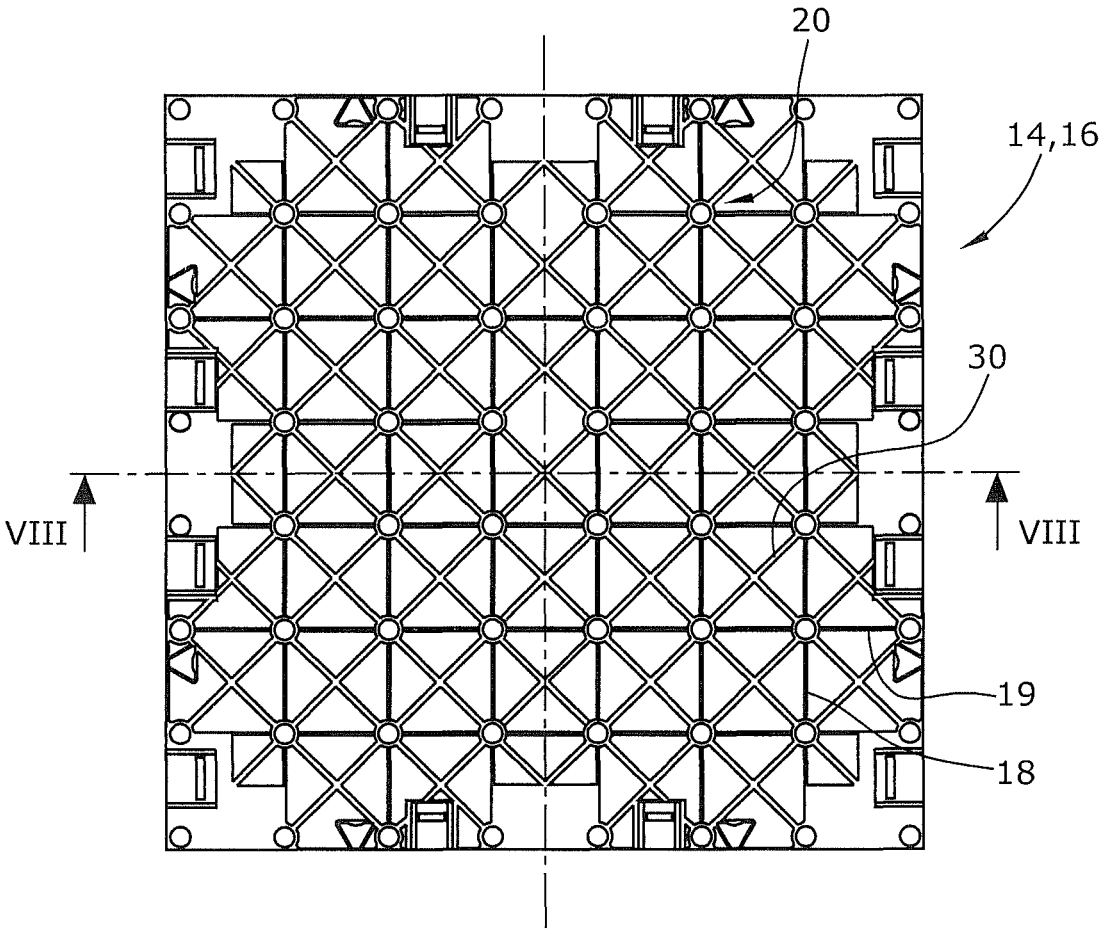
FIG. 7 is a top plan view on a grid plate cover or bottom element.
Figure 8:
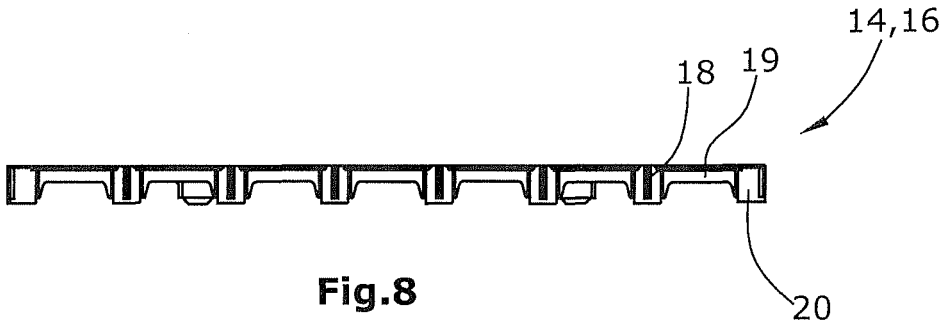
FIG. 8 is s section along line VIII-VIII in FIG. 7.

FIGS. 1 and 2 illustrate two dewatering and/or drainage bodies 10, 10' as can be assembled from the system of the present invention. Both bodies 10, 10' comprise a plurality of intermediate grid plate elements 12 arranged one above the other, forming a stack that is covered at the top and the bottom by a grid plate top element 14 and a grid plate bottom element 16, respectively. The intermediate grid plate elements 12 are illustrated in more detail in FIGS. 3 to 6, whereas the identical grid plate top and bottom elements are shown in more detail in FIGS. 7 and 8.

Referring to FIGS. 3 to 6, each intermediate grid plate element 12 is of a rectangular shape, in particular of square shape, and is provided with grate struts 18, 19 which, in this embodiment, extend at right angles in rows and columns. At the crossings of these grate struts 18, 19, support members 20 are provided which, in this embodiment, are designed as hollow bolts or the like. The support members 20 extend from the top 22 of a intermediate grid plate element 12 to the bottom 24 thereof. At one of their ends, the support members 20 have a connecting projection 26, whereas the other end is open and forms a connecting projection receptacle 28 for receiving a connecting projection 26. The orientation of the support members 20 is inverted between adjacent support members 20 or between adjacent groups of support members 20. In this manner, adjacent intermediate grid plate elements 12 can be assembled by plugging, with the support members 20 of adjacent intermediate grid plate elements 12 resting one upon the other, whereby they absorb load in the stacking direction of the body 10 or 10', respectively.

The grid plate top elements and the grid plate bottom elements 14, 16 are also rectangular in shape, and in particular square, and further have cross grate struts 30, besides the grate struts 18, 19 extending in columns and rows. As can be seen in particular in FIG. 8, the grid plate top and bottom elements also comprise support members 20 which, however, protrude only from one side of these elements. The other side (the top side in FIG. 8) is substantially free of protrusions. This protrusion-free side forms either the top side of the body 10 or 10' or the bottom side of this body 10 or 10'.

As can be seen in FIG. 2, a flushing channel 34 can run through the body 10' in an intermediate plane 32. The flushing channel 34 may be circular or angular in cross section and extends transversely to the stacking direction of the body 10'. In the embodiment of FIG. 2, the flushing channel 34 is formed by a total of four grid flow channel sub-elements 36 which are all of identical shape and are arranged with respect to each other as illustrated in FIG. 2. The grid flushing channel sub-elements are illustrated in more detail in FIGS. 9 to 11 and also comprise crossing grate struts 18, 19 extending in columns and rows, whose crossings are likewise provided with support members 20 as described above. In addition, each grid flushing channel sub-element 36 has an edge 38 forming the inner side portion 40 of the flushing channel 34 that extends over a quarter of the cross section thereof. As illustrated in FIG. 2, two respective grid flushing channel sub-elements 36 are arranged symmetrically to a plane extending in the stacking direction, the elements being arranged in two superposed planes, with the two respective grid flushing channel sub-elements 36 of the two superposed planes being arranged symmetrically to a plane that is transversal to the stacking direction. The inner side portions 40 at the edges are provided with perforations 42.

Figure 9:
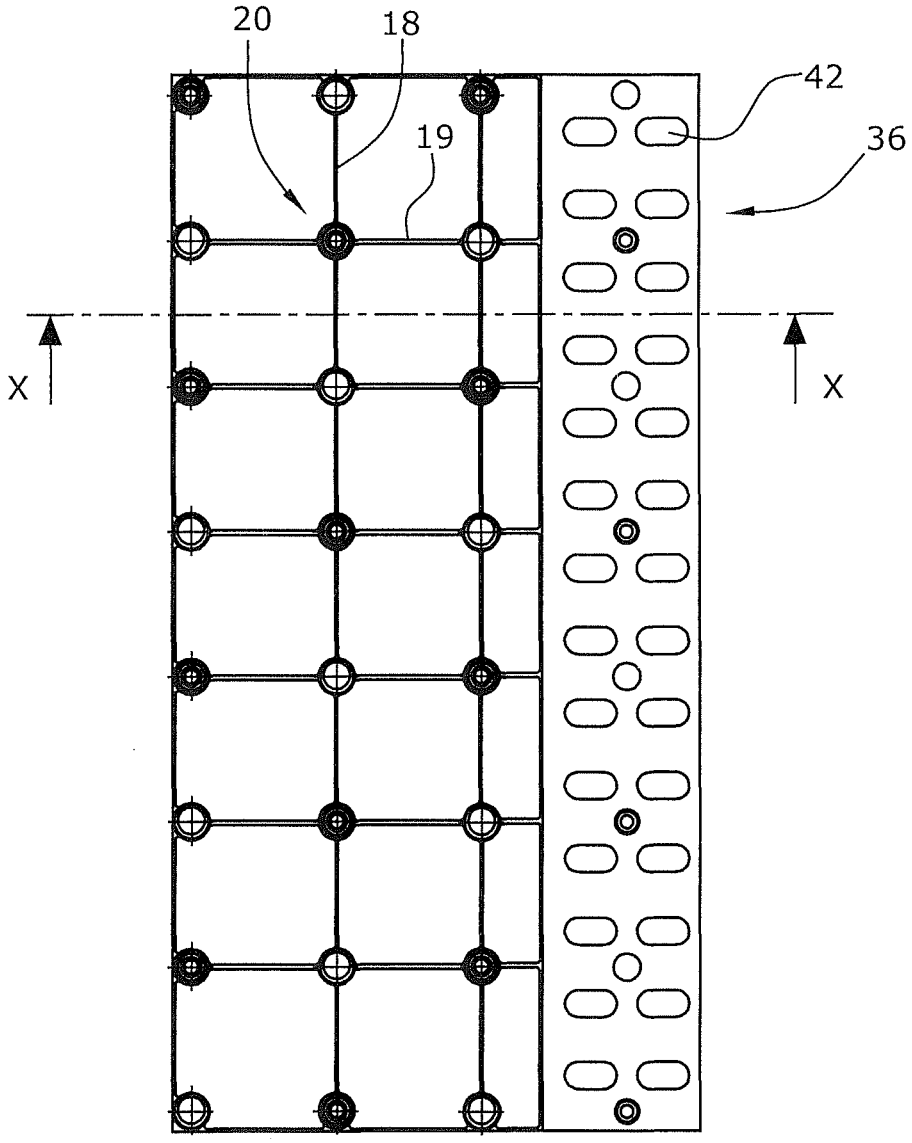
FIG. 9 is a top plan view on a grid flushing channel sub-element.
Figure 10:
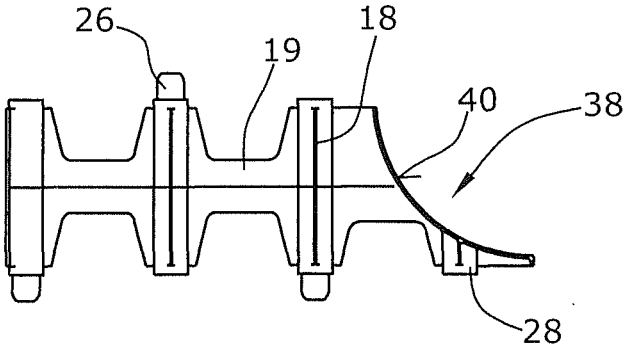
FIG. 10 is a section along line X-X through the grid flushing channel sub-element of FIG. 9.
Figure 11:
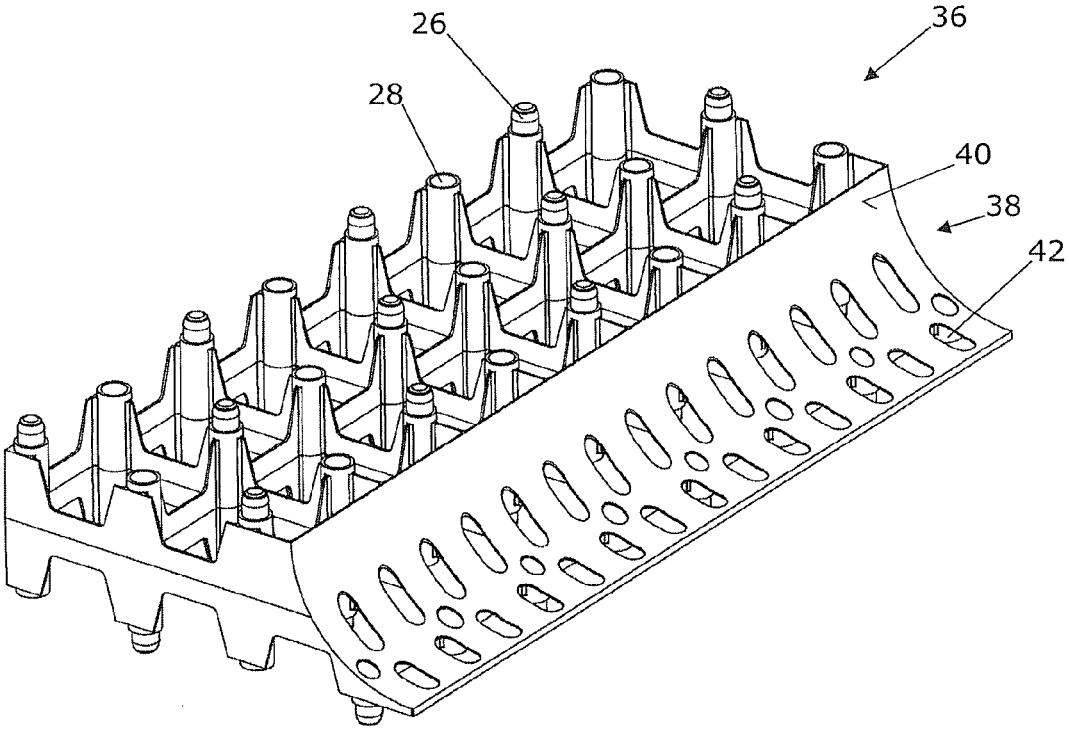
FIG. 11 is a perspective view of the grid flushing channel sub-element of FIG. 9.
Figure 12:
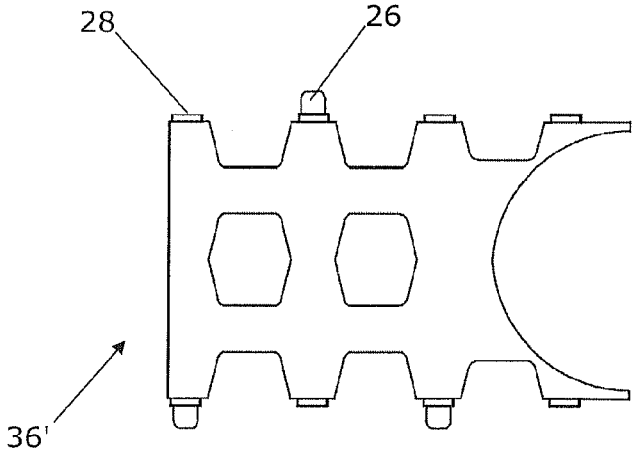
FIG. 12 is a cross section through an alternatively designed grid flushing channel sub-element for forming the intermediate flushing channel plane in the dewatering and/or drainage body of FIG. 2.

FIG. 12 is a side elevational view of an alternatively designed grid flushing channel sub-element 36' which takes the form of an integral element formed from two superposed grid flushing channel sub-elements 36 illustrated in FIGS. 9 to 11.

Summarizing, a dewatering and drainage body of modular structure for a dewatering or drainage device has been described, which is assembled from a maximum of three different parts. The height of the body can be adapted to the space existing in situ. The abutting support members 20 of all grid plate elements forming the stack, which support members extend in the stacking direction, provide for a high load absorbing capacity in the stacking direction, thereby preventing the body from collapsing under the load of the soil placed thereon (in the installed state). The entire body is suitably enclosed by a permeable cover material (for example, a non-woven), whereby the intrusion of earth and stone or the like soil components into the body is prevented.

Although the invention has been described and illustrated with reference to specific illustrative embodiments thereof, it is not intended that the invention be limited to those illustrative embodiments. Those skilled in the art will recognize that variations and modifications can be made without departing from the true scope of the invention as defined by the claims that follow. It is therefore intended to include within the invention all such variations and modifications as fall within the scope of the appended claims and equivalents thereof.

What is claimed is:

1. A device for the treatment, cooling or storage of a fluid such as, for instance, a gas or a liquid, which is provided with a plurality of intermediate grid plate elements with a top surface, a bottom surface, and a middle plane therebetween, which are adapted to be positioned one on top of the other, wherein each intermediate grid plate element comprises a grate strutting as well as a plurality of support members which are distributed, in particular in a regular manner, over the intermediate grid plate element, wherein said support members extend between the bottom surface and the top surface and protrude to both sides of the middle plane of the respective intermediate grid plate element in a direction substantially transverse to the extension of the intermediate grid plate elements and bear on the support members of an adjacent intermediate grid plate element arranged below a respective intermediate grid plate element, and bear the support members of an adjacent intermediate grid plate element arranged above said respective intermediate grid plate element, wherein the support members are of a strand-shaped design and are, in particular, formed as hollow or solid bolts, their opposite ends being provided with a connecting projection at the one end and a connecting projection receptacle at the other end, and wherein adjacent intermediate grid plate elements are plugged together by means of the connecting projections and the connecting projection receptacle with the support members being connected in a load transmitting manner, wherein, within one intermediate grid plate, the connecting projections and connecting projection receptacles arranged at adjacent support member or at support members of adjacent groups of support members are alternately provided along both sides of the middle plane so that a connecting projection is followed by a connecting projection receptacle or a group of mutually adjacent projections is followed by a group of mutually adjacent connecting projection receptacles, and a grid plate top element is placed on the topmost intermediate grid plate element in the stack and a grid plate bottom element is placed under the lowermost grid plate element in the stack, which top and bottom elements are identical and each comprise a grate strutting and support members protruding from a planar surface in one direction only for connection with the support members of the topmost or the lowermost intermediate grid plate element of the stack, wherein the alternating arrangement of connecting projections and connecting projection receptacles or of groups of connecting projections and groups of connecting projection receptacles at the support members of the grid plate top element is the same as that at the support members of the intermediate grid plate elements.

2. The device of claim 1, wherein a grid flushing or inspection channel element is arranged between two adjacent intermediate grid plate elements, the grid flushing or inspection channel element comprising a top face and a bottom face, a grate strutting comprising a flushing or inspection channel extending transversely to the thickness between the top and bottom faces, and support members extending from the top face to the bottom face for connection with the support members of the respective intermediate grid plate element arranged above or below the grid flushing or inspection channel element.

3. The device of claim 2, wherein the grid flushing or inspection channel element comprises four identical grid channel sub-elements, of which a first pair is arranged side by side and a second pair is arranged on the first pair, wherein each grid channel sub-element comprises a grate strutting with support members substantially extending transversely to the extension thereof, and further comprises a channel inner side portion at one edge, which portion substantially extends over one quarter of the channel cross section and is provided with perforations, wherein two respective juxtaposed grid channel sub-elements extend symmetrically with respect to a plane extending in the direction of stacking and two respective grid channel sub-elements arranged one on top of the other are arranged symmetrically with respect to a plane extending transversely to the direction of stacking.

4. The device of claim 2, wherein the grid flushing or inspection channel element comprises two identical grid channel sub-elements arranged side by side and symmetrically to a plane extending in the direction of stacking, wherein each grid channel sub-element comprises a grate strutting with support members extending substantially transversely to the extension thereof and an edge, forming an inner side portion of the channel extending over substantially half the cross section of the channel and being provided with perforations.

* * * * *